US012152857B2

(12) United States Patent
Lee et al.

(10) Patent No.: US 12,152,857 B2
(45) Date of Patent: Nov. 26, 2024

(54) FIREARM HANDGUARD CABLE ORGANIZER

(71) Applicant: Strike IP, LLC, Las Vegas, NV (US)

(72) Inventors: Shanyao Lee, Santa Ana, CA (US); Hung-Ju Lee, Santa Ana, CA (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 17/527,339

(22) Filed: Nov. 16, 2021

(65) Prior Publication Data

US 2023/0152056 A1 May 18, 2023

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 4,533,980 A * 8/1985 Hayes ..... F41G 1/345 362/249.05
5,103,366 A * 4/1992 Battochi ..... F41B 15/04 361/232
5,237,773 A * 8/1993 Claridge ..... F41G 1/35 42/117
5,345,707 A * 9/1994 Randall ..... F41G 1/35 42/117
5,822,905 A * 10/1998 Teetzel ..... F41G 1/36 42/117
6,568,118 B1 * 5/2003 Teetzel ..... F41G 3/06 42/105
7,243,454 B1 * 7/2007 Cahill ..... F41C 23/16 42/72
7,464,495 B2 * 12/2008 Cahill ..... F41C 23/12 42/72
7,627,975 B1 * 12/2009 Hines ..... F41G 11/003 42/84
7,841,120 B2 * 11/2010 Teetzel ..... F41A 23/08 42/72
8,028,460 B2 * 10/2011 Williams ..... F41G 11/003 42/84
8,091,265 B1 * 1/2012 Teetzel ..... F41C 23/16 42/71.01
8,104,211 B2 * 1/2012 Darian ..... F41C 27/00 42/84
8,225,542 B2 * 7/2012 Houde-Walter ..... F41C 23/16 42/72
8,516,731 B2 * 8/2013 Cabahug ..... F41G 11/003 42/72
8,549,783 B2 * 10/2013 Marquez ..... F41C 7/00 42/71.01

(Continued)

*Primary Examiner* — Michelle Clement
(74) *Attorney, Agent, or Firm* — Andy M. Han; Han IP PLLC

(57) ABSTRACT

A apparatus implementable on a firearm includes a handguard assembly which is configured to at least partially surround a barrel of the firearm when the handguard is installed on the firearm. The handguard includes at least first and second physical features such that: (a) the first physical feature is configured to accommodate mounting of an accessory of the firearm on the handguard, and (b) the second physical feature is configured to secure a cable of the accessory onto the handguard.

13 Claims, 7 Drawing Sheets

(56) References Cited

U.S. PATENT DOCUMENTS 8,635,798 B2 * 1/2014 Mulfinger ..... H01R 13/24 42/84
8,850,735 B2 * 10/2014 Kenney ..... F41A 3/66 42/106
8,875,434 B2 * 11/2014 Michal ..... F41C 23/22 42/96
8,985,397 B2 * 3/2015 Lord ..... F41H 9/10 222/402.1
9,182,194 B2 * 11/2015 Moore ..... F41G 1/35
9,194,652 B2 * 11/2015 Esserman ..... F41C 23/16
9,200,867 B1 * 12/2015 Swan ..... F41C 23/16
9,488,436 B2 * 11/2016 Abst ..... F41G 11/003
9,829,274 B2 * 11/2017 Vallo ..... F41C 23/18
9,841,248 B2 * 12/2017 Bybee ..... F41C 23/16
9,841,254 B2 * 12/2017 Moore ..... F41C 23/22
9,891,023 B2 * 2/2018 Compton ..... H04B 5/0031
9,966,204 B2 * 5/2018 McCauley ..... F41G 11/003
10,082,363 B2 * 9/2018 Burgess ..... F41G 11/003
10,514,235 B1 * 12/2019 McCauley ..... H01H 9/02
10,551,149 B2 * 2/2020 Teetzel ..... F41G 11/003
10,663,261 B2 * 5/2020 Summerfield ..... F41G 11/003
10,845,158 B2 * 11/2020 Mezynski ..... F41C 23/16
10,976,131 B1 * 4/2021 Cabahug ..... F41C 23/16
11,175,114 B1 * 11/2021 Lee ..... F16L 3/02
11,595,079 B2 * 2/2023 Ellena ..... H04L 12/10
2007/0074442 A1 * 4/2007 Richeson ..... F41G 1/35 42/71.01
2009/0044439 A1 * 2/2009 Phillips ..... F41C 23/16 42/72
2010/0031552 A1 * 2/2010 Houde-Walter ..... F41C 23/16 42/72
2010/0083553 A1 * 4/2010 Montgomery ..... F41C 27/00 42/84
2010/0180485 A1 * 7/2010 Cabahug ..... F41C 27/00 42/90
2010/0192444 A1 * 8/2010 Cabahug ..... F41G 11/003 42/71.01
2010/0192446 A1 * 8/2010 Darian ..... F41G 11/003 320/108
2011/0010979 A1 * 1/2011 Houde-Walter ..... F41C 27/00 42/84
2011/0131858 A1 * 6/2011 Darian ..... F41G 11/003 42/90
2011/0283585 A1 * 11/2011 Cabahug ..... F41G 11/003 42/73
2012/0131837 A1 * 5/2012 Cabahug ..... F41C 27/00 42/84
2012/0144716 A1 * 6/2012 Cabahug ..... F41C 23/22 42/84
2012/0192476 A1 * 8/2012 Compton ..... H04B 5/0037 42/84
2012/0266514 A1 * 10/2012 Michal ..... F41G 1/34 42/90
2013/0047482 A1 * 2/2013 Mulfinger ..... H01R 13/24 42/84
2013/0061504 A1 * 3/2013 Malherbe ..... F41G 11/003 42/84
2013/0104439 A1 * 5/2013 Hines ..... F41G 11/003 42/84
2014/0115936 A1 * 5/2014 Kenney ..... F41G 11/003 42/16
2014/0130392 A1 * 5/2014 Oh ..... F41C 23/22 42/84
2014/0360077 A1 * 12/2014 Miller ..... F41C 27/00 42/84
2015/0020427 A1 * 1/2015 Compton ..... H02J 50/80 42/71.01
2016/0061560 A1 * 3/2016 Saadon ..... F41C 23/14 42/72
2016/0209169 A1 * 7/2016 Toole ..... F41G 1/36
2016/0216082 A1 * 7/2016 Downing ..... F41G 3/06
2016/0305739 A1 * 10/2016 Garst ..... F41C 23/18
2016/0327371 A1 * 11/2016 Teetzel ..... F41C 23/16
2016/0356567 A1 * 12/2016 Bybee ..... F41C 23/16
2017/0038178 A1 * 2/2017 Pinilla ..... F41C 23/16
2017/0205202 A1 * 7/2017 Teetzel ..... F41C 27/00
2018/0164071 A1 * 6/2018 Burgess ..... F41G 11/003
2019/0244771 A1 * 8/2019 Nobes ..... F41C 23/20
2021/0270573 A1 * 9/2021 Verjovsky ..... F41C 23/22
2021/0389065 A1 * 12/2021 Admanit ..... F41C 23/22
2022/0221246 A1 * 7/2022 Tanaka ..... F41C 23/10
2022/0404114 A1 * 12/2022 Lee ..... F41C 23/16
2022/0408586 A1 * 12/2022 Lee ..... F41C 27/00
2023/0017012 A1 * 1/2023 Serbu ..... F41C 23/16
2023/0110575 A1 * 4/2023 Cinco ..... F16G 11/10 42/90
2023/0239003 A1 * 7/2023 Ellena ..... H04B 3/54 375/257

* cited by examiner

FIREARM HANDGUARD CABLE ORGANIZER

TECHNICAL FIELD

The present disclosure is generally related to firearms and, more particularly, to a handguard cable organizer for firearms.

BACKGROUND

Unless otherwise indicated herein, approaches described in this section are not prior art to the claims listed below and are not admitted as prior art by inclusion in this section.

A handguard (also known as forend or forearm) on a firearm refers to a guard attached to the front portion of the firearm to shield or otherwise protect a user from the barrel of the firearm, which can become very hot when firing. On an AR-style or AK-style firearm, whether a rifle, carbine, pistol or shotgun, the handguard is typically secured on a barrel nut of the firearm by either screws or another locking mechanism which requires tools to operate. With the handguard installed, the barrel of the AR-style or AK-style firearm (which typically includes a gas block, a gas tube or a piston system) is at least partially surrounded by and shielded inside the handguard.

The user can choose to mount or otherwise install one or more mechanical and/or electronic accessories on the handguard. Certain electronic accessories, such as light and/or laser, may have an ON/OFF switch connected to the light or laser via a cord or cable so that the light and/or laser can be mounted towards the front end of the firearm on the handguard (e.g., closer to a muzzle of the barrel) while the switch is mounted somewhere rearward on the handguard to be closer to the user for ease of reach by a hand or finger(s) of the user. As different firearms can have different barrel lengths (and hence different lengths for the handguard), the length of the cord or cable of an electronic accessory, which is usually fixed, tends to be long in order to accommodate firearms with a long handguard. However, when the electronic accessory is installed on a firearm with a short handguard, the length of the cord or cable of the electronic accessory could be relatively excessive and thus difficult to organize. For instance, an excessive long cable could cause the cable to tangle easily. Even worse, the excessive length could catch objects during usage (e.g., firing) of the firearm, thereby imposing a safety hazard. Therefore, there is need for a solution of a firearm handguard cable organizer.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a firearm handguard cable organizer. It is believed that a firearm handguard cable organizer under various proposed schemes of the present disclosure may address or otherwise alleviate the aforementioned issues.

In one aspect, a device implementable on a firearm may include a handguard which is configured to at least partially surround a barrel of the firearm when the handguard is installed on the firearm. The handguard may include at least first and second physical features such that: (a) the first physical feature is configured to accommodate mounting of an accessory of the firearm on the handguard, and (b) the second physical feature is configured to secure a cable of the accessory onto the handguard.

In another aspect, a device implementable on a firearm may include a handguard which is configured to at least partially surround a barrel of the firearm when the handguard is installed on the firearm. The handguard may include at least first and second physical features such that: (a) the first physical feature is configured to accommodate mounting of an accessory of the firearm on the handguard, and (b) the second physical feature is configured to secure a cable of the accessory onto the handguard. The first physical feature may be configured to accommodate the mounting of the accessory on an exterior surface of the handguard. The second physical feature may be configured to secure at least one portion of the cable of the accessory onto an interior surface of the handguard different from the exterior surface. The second physical feature may include at least one notch on an edge of a wall of the handguard or at least one opening on the wall of the handguard. The second physical feature may also include a protrusion with at least one indentation and disposed on the interior surface of the handguard.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
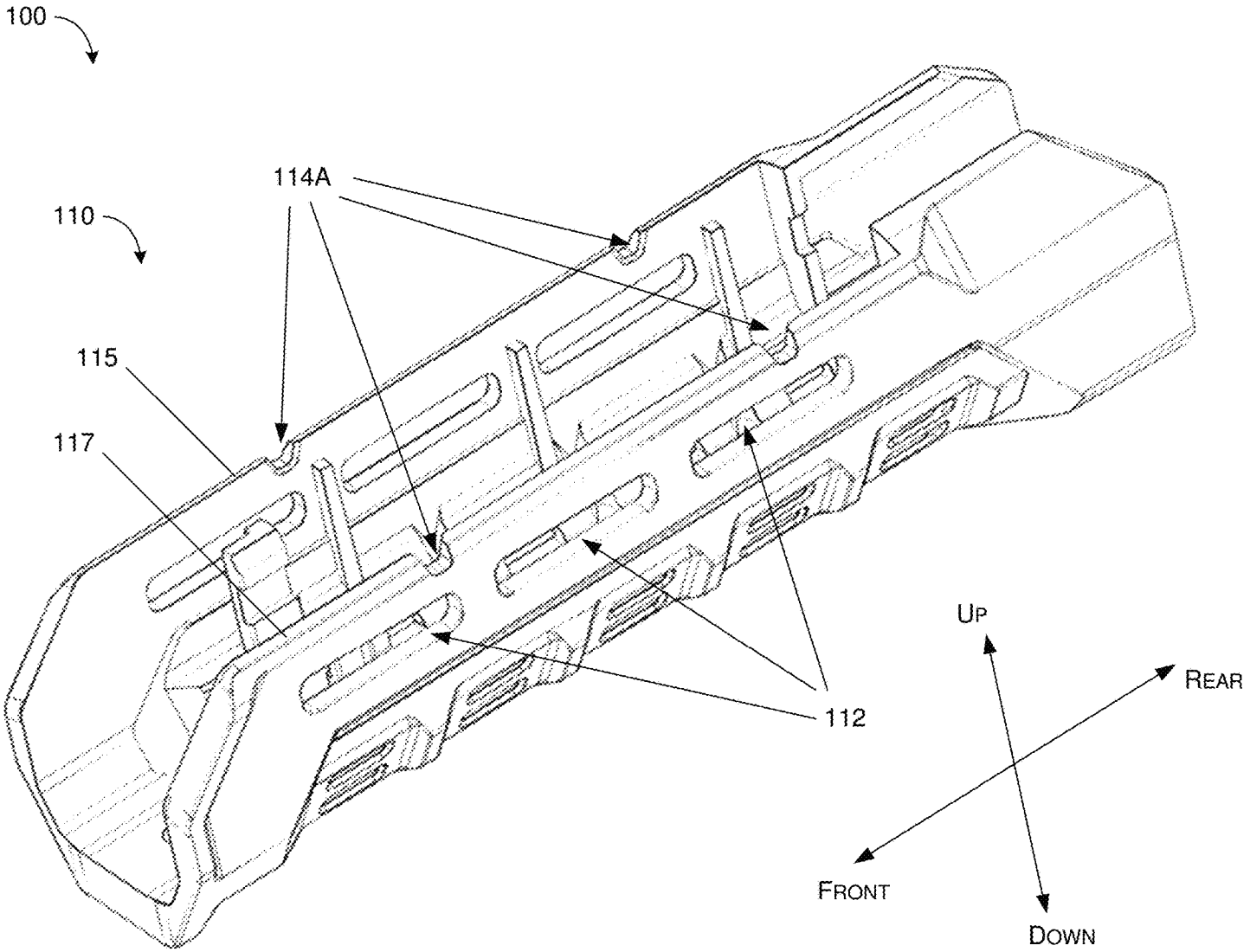
FIG. 1 is a diagram of a device implementable on a firearm in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 7 regarding a device implementable on a firearm 300, which may be an AR-style firearm or an AK-style firearm. The device may include a handguard 110 configured to at least partially surround a barrel 310 of the firearm 300 when the handguard 100 is installed on the firearm 300. It is noteworthy that, although a different design is shown in each of FIG. 2~FIG. 6, in some implementations some or all of the designs may be implemented in one handguard. In other words, in some implementations, two or more of the different designs may be implemented in a single handguard in accordance with the present disclosure, while in some other implementations, one of the different designs may be implemented in a single handguard in accordance with the present disclosure. Therefore, although each of FIG. 2~FIG. 6 shows a respective design, the feasibility of multiple ones of the different designs being implemented in a single handguard is not precluded or otherwise excluded.

Referring to FIG. 1, handguard 100 may include at least a lower handguard portion 110 configured to at least partially surround a barrel 310 of the firearm 300 when the handguard 100 is installed on the firearm 300. The lower handguard portion 110 may include at least first physical feature 112 and second physical feature 114A/114B such that: (a) the first physical feature 112 is configured to accommodate mounting of an accessory 200 of the firearm 300 on the handguard 100, and (b) the second physical feature 114A/114B is configured to secure a cable 210 of the accessory 200 onto the handguard 100.

In some implementations, the first physical feature 112 may include one or more slots or openings. Alternatively, or additionally, the first physical feature 112 may include an interface system such as, for example and without limitation, a Modular Lock (M-LOK) interface system, a KeyMod interface system, a Picatinny rail, a Weaver rail, or any combination thereof.

In some implementations, the second physical feature 114A/114B may include: (i) at least one notch 114A on an edge 115 and/or 117 of one or more walls of the lower handguard portion 110 (as shown in FIG. 1~FIG. 5) or at least one opening 114A on the wall of the handguard 100 (as shown in FIG. 6, formed by corresponding notches on the upper handguard portion 120 and the lower handguard portion 110), and (ii) a protrusion 114B with at least one indentation and disposed on an interior surface of the lower handguard portion 110 such that a portion of the cable 210 may be secured by the second physical feature (e.g., by being stuffed in and squeezed by the at least one indentation of the protrusion 114B).

In some implementations, the handguard 100 may be a monolithic handguard (e.g., made of polymer by injection molding) having the first physical feature 112 and the second physical feature 114A/114B.

Figure 2:
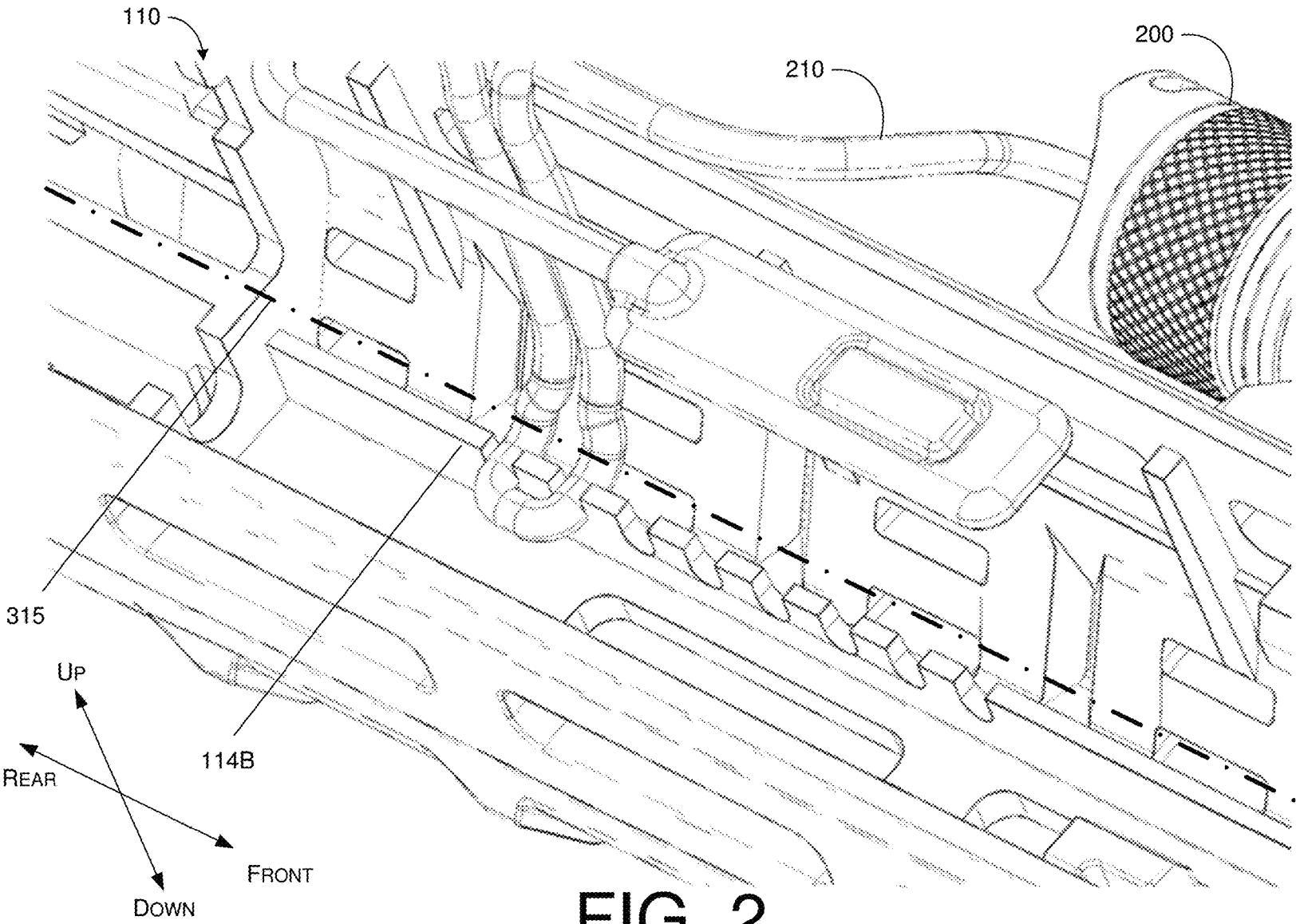
FIG. 2 is a diagram of a first design of the device of FIG. 1.

Referring to FIG. 2, the first physical feature 112 may be configured to accommodate the mounting of the accessory 200 on a first primary surface of the handguard 100. Moreover, the second physical feature 114A/114B may be configured to secure at least one portion of the cable 210 of the accessory 200 onto a second primary surface of the handguard 100 different from the first primary surface, thereby allowing a user of the firearm 300 to turn on and off the accessory 200 by activating and deactivating a switch 220 of the accessory 200. The second primary surface may be opposite the first primary surface. For instance, the first primary surface may include an exterior surface of the handguard 100 (e.g., an exterior surface of lower handguard portion 110). Correspondingly, the second primary surface may include an interior surface of the handguard 100 (e.g., an interior surface of lower handguard portion 110) facing the barrel 310 of the firearm 300 when the handguard 100 is installed on the firearm 300.

In the design shown in FIG. 2, the protrusion 114B may include a ridge-shaped protrusion extending along a direction parallel to a longitudinal axis 315 of the barrel 310. Accordingly, at least one portion of the cable 210 of the accessory 200 may enter a space between the handguard 100 and the barrel 310 of the firearm 300 through the at least one notch 114A on the wall 115/117 of the handguard 100 so that the at least one portion of the cable 210 may be secured by the at least one indentation on the protrusion 114B.

In the design shown in FIG. 2, an opening formed by the at least one indentation may face upward with respect to the firearm 300 when the handguard 100 is installed on the firearm 300 such that the at least one portion of the cable 210 is inserted into or removed from the opening formed by the at least one indentation by a downward or upward movement with respect to the firearm 300, respectively.

Figure 3:
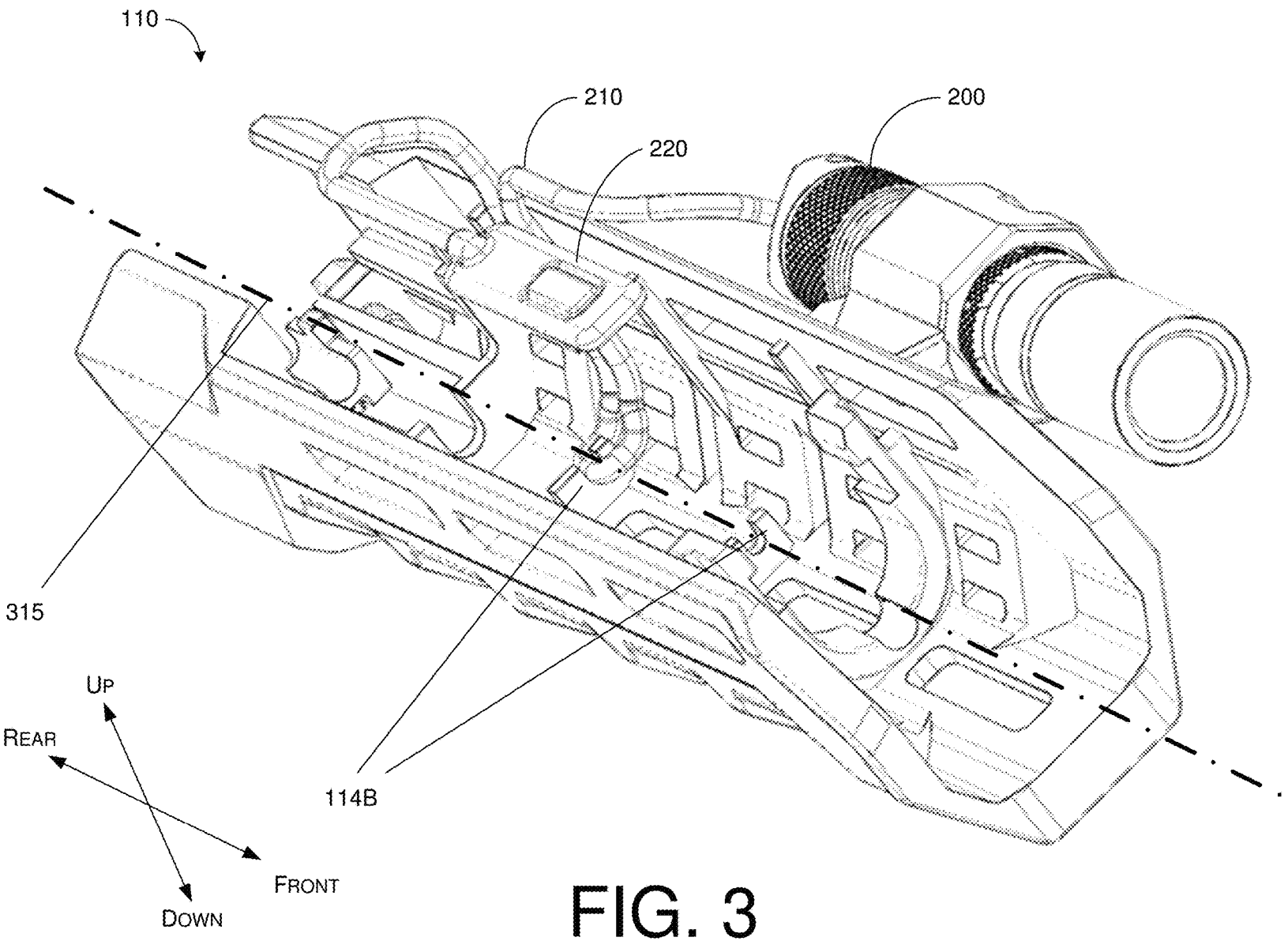
FIG. 3 is a diagram of a first design of the device of FIG. 1.

Referring to FIG. 3, the first physical feature 112 may be configured to accommodate the mounting of the accessory 200 on a first primary surface of the handguard 100. Moreover, the second physical feature 114A/114B may be configured to secure at least one portion of the cable 210 of the accessory 200 onto a second primary surface of the handguard 100 different from the first primary surface, thereby allowing a user of the firearm 300 to turn on and off the accessory 200 by activating and deactivating a switch 220 of the accessory 200. The second primary surface may be opposite the first primary surface. For instance, the first primary surface may include an exterior surface of the handguard 100 (e.g., an exterior surface of lower handguard portion 110). Correspondingly, the second primary surface may include an interior surface of the handguard 100 (e.g., an interior surface of lower handguard portion 110) facing the barrel 310 of the firearm 300 when the handguard 100 is installed on the firearm 300.

In the design shown in FIG. 3, the protrusion 114B may include a ridge-shaped protrusion extending along a direction perpendicular to a longitudinal axis 315 of the barrel 310. In this design, the protrusion 114B may protrude upwardly from a bottom interior surface of the lower handguard portion 110. Accordingly, at least one portion of the cable 210 of the accessory 200 may enter a space between the handguard 100 and the barrel 310 of the firearm 300 through the at least one notch 114A on the wall 115/117 of the handguard 100 so that the at least one portion of the cable 210 may be secured by the at least one indentation on the protrusion 114B.

In the design shown in FIG. 3, an opening formed by the at least one indentation may face upward with respect to the firearm 300 when the handguard 100 is installed on the firearm 300 such that the at least one portion of the cable 210 is inserted into or removed from the opening formed by the at least one indentation by a downward or upward movement with respect to the firearm 300, respectively.

Figure 4:
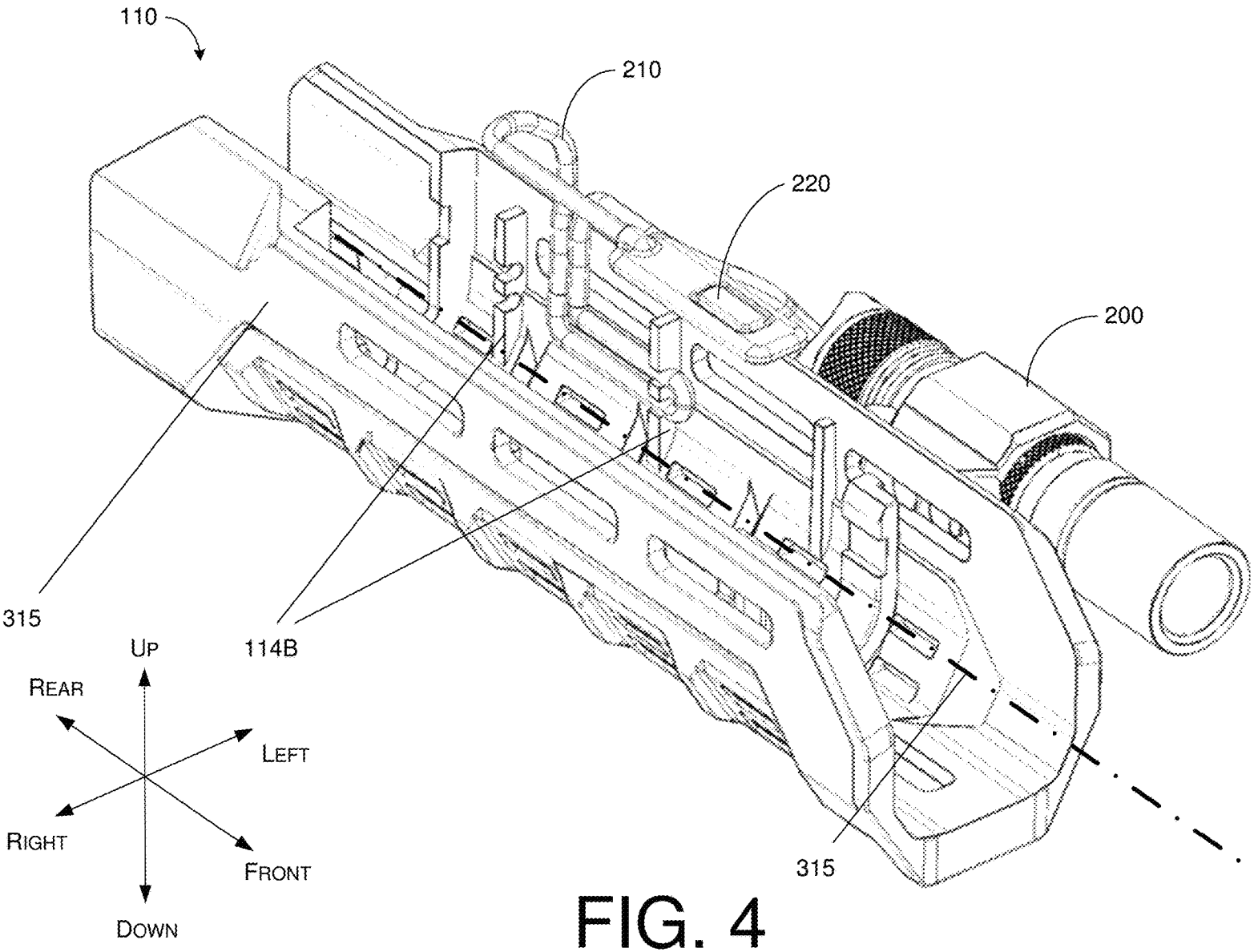
FIG. 4 is a diagram of a first design of the device of FIG. 1.

Referring to FIG. 4, the first physical feature 112 may be configured to accommodate the mounting of the accessory 200 on a first primary surface of the handguard 100. Moreover, the second physical feature 114A/114B may be configured to secure at least one portion of the cable 210 of the accessory 200 onto a second primary surface of the handguard 100 different from the first primary surface, thereby allowing a user of the firearm 300 to turn on and off the accessory 200 by activating and deactivating a switch 220 of the accessory 200. The second primary surface may be opposite the first primary surface. For instance, the first primary surface may include an exterior surface of the handguard 100 (e.g., an exterior surface of lower handguard portion 110). Correspondingly, the second primary surface may include an interior surface of the handguard 100 (e.g., an interior surface of lower handguard portion 110) facing the barrel 310 of the firearm 300 when the handguard 100 is installed on the firearm 300.

In the design shown in FIG. 4, the protrusion 114B may include a ridge-shaped protrusion extending along a direction perpendicular to a longitudinal axis 315 of the barrel 310. Accordingly, at least one portion of the cable 210 of the accessory 200 may enter a space between the handguard 100 and the barrel 310 of the firearm 300 through the at least one notch 114A on the wall 115/117 of the handguard 100 so that the at least one portion of the cable 210 may be secured by the at least one indentation on the protrusion 114B.

In the design shown in FIG. 4, an opening formed by the at least one indentation may face left or right with respect to the firearm 300 when the handguard 100 is installed on the firearm 300 such that the at least one portion of the cable 210 is inserted into or removed from the opening formed by the at least one indentation by a rightward or leftward movement with respect to the firearm 300, respectively.

Figure 5:
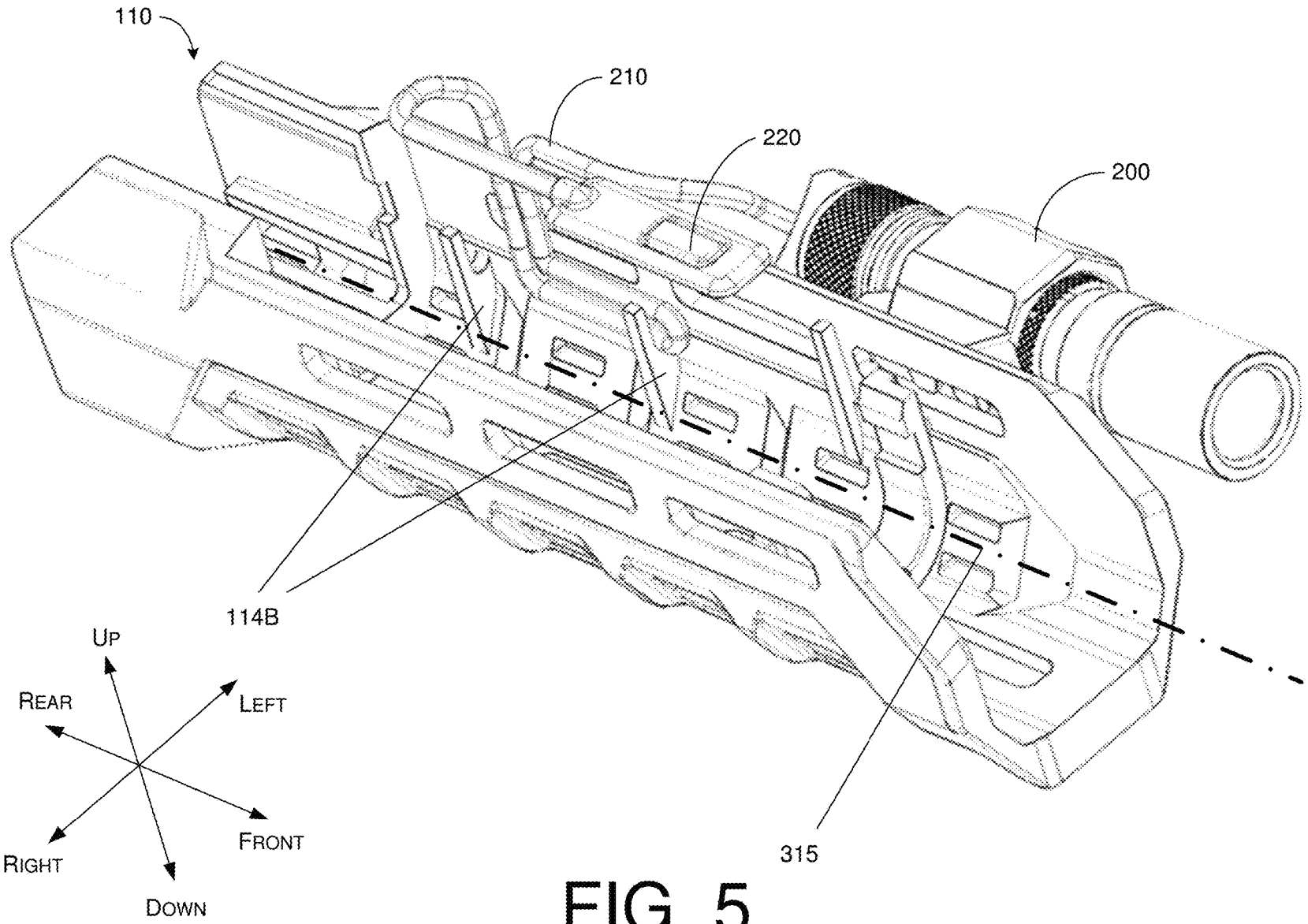
FIG. 5 is a diagram of a first design of the device of FIG. 1.
Figure 6:
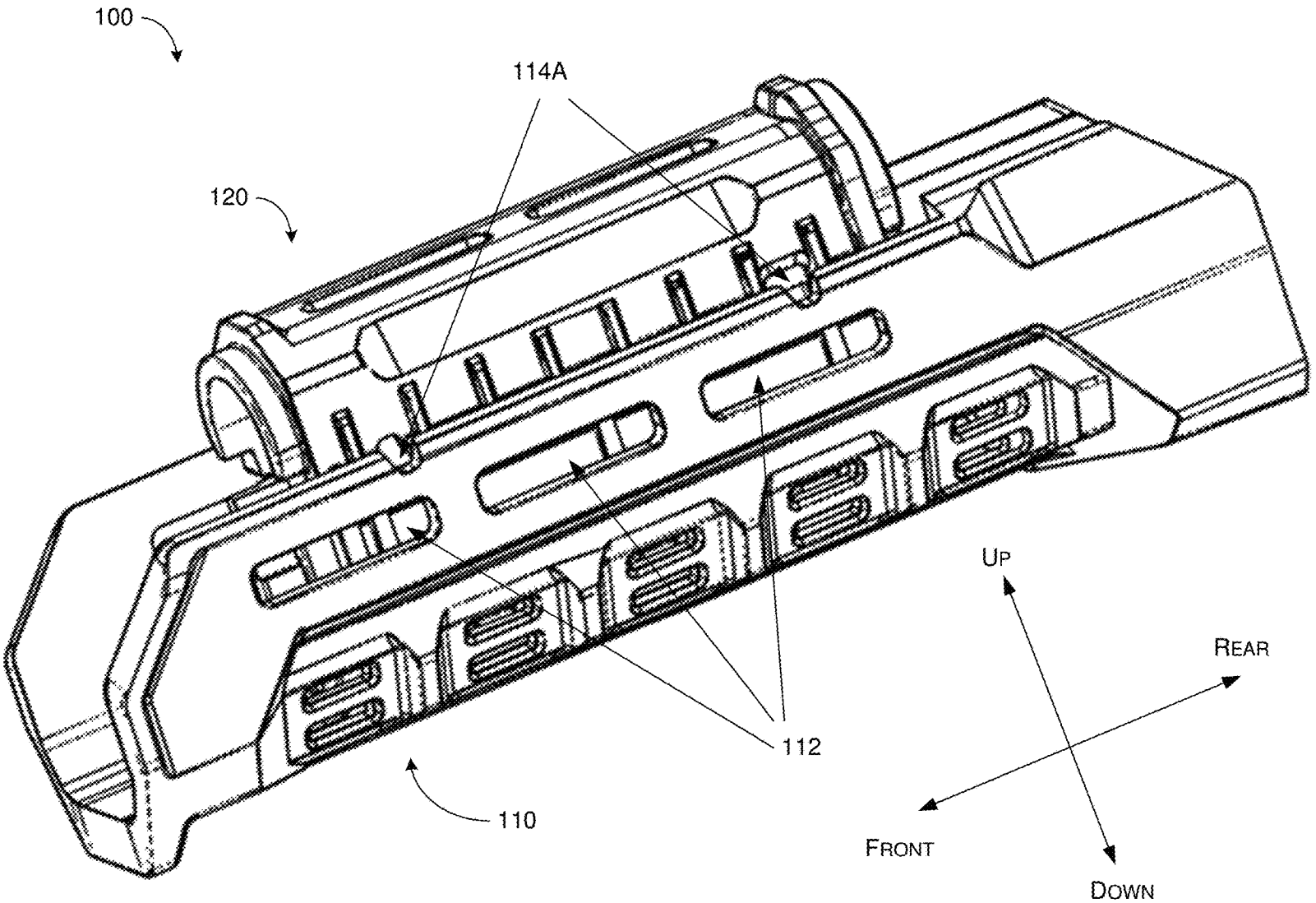
FIG. 6 is a diagram of a device implementable on a firearm in accordance with another implementation of the present disclosure.

Referring to FIG. 5, the first physical feature 112 may be configured to accommodate the mounting of the accessory 200 on a first primary surface of the handguard 100. Moreover, the second physical feature 114A/114B may be configured to secure at least one portion of the cable 210 of the accessory 200 onto a second primary surface of the handguard 100 different from the first primary surface, thereby allowing a user of the firearm 300 to turn on and off the accessory 200 by activating and deactivating a switch 220 of the accessory 200. The second primary surface may be opposite the first primary surface. For instance, the first primary surface may include an exterior surface of the handguard 100 (e.g., an exterior surface of lower handguard portion 110). Correspondingly, the second primary surface may include an interior surface of the handguard 100 (e.g., an interior surface of lower handguard portion 110) facing the barrel 310 of the firearm 300 when the handguard 100 is installed on the firearm 300.

In the design shown in FIG. 5, the protrusion 1148 may include a ridge-shaped protrusion extending along a direction perpendicular to a longitudinal axis 315 of the barrel 310. In this design, the protrusion 114B may protrude upwardly from a side interior surface of the lower handguard portion 110. Accordingly, at least one portion of the cable 210 of the accessory 200 may enter a space between the handguard 100 and the barrel 310 of the firearm 300 through the at least one notch 114A on the wall 115/117 of the handguard 100 so that the at least one portion of the cable 210 may be secured by the at least one indentation on the protrusion 1148.

In the design shown in FIG. 5, an opening formed by the at least one indentation may face upward with respect to the firearm 300 when the handguard 100 is installed on the firearm 300 such that the at least one portion of the cable 210 is inserted into or removed from the opening formed by the at least one indentation by a downward or upward movement with respect to the firearm 300, respectively.

Referring to FIG. 6, the handguard 100 may include: (i) an upper handguard portion 120 configured to shield an upper portion of the barrel 310 when the handguard 100 is installed on the firearm 300, and (ii) a lower handguard portion 110 configured to shield a lower portion of the barrel 310 when the handguard 100 is installed on the firearm 300. In some implementations, both the first physical feature 112 and the second physical feature 114A/114B may be at least partially formed on the lower handguard portion 110, as shown in FIG. 1~FIG. 5.

Figure 7:
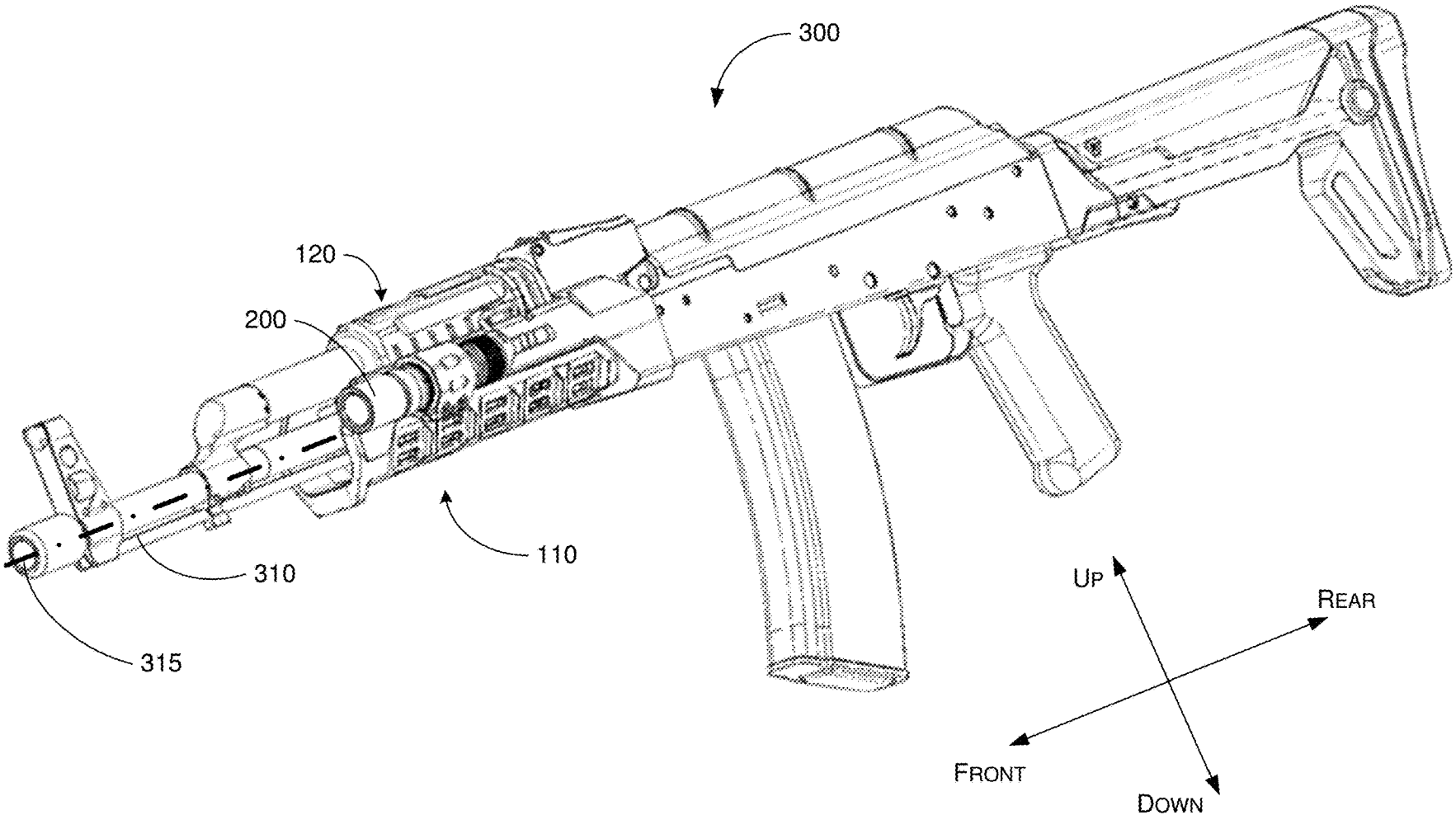
FIG. 7 is a diagram of a firearm with a device in accordance with an implementation of the present disclosure implemented thereon.

FIG. 7 illustrates firearm 300 with the device in accordance with an implementation of the present disclosure, as well as accessory 200 (e.g., a flashlight, a laser, or a combination of flashlight and laser) implemented thereon.

Highlight of Select Features

In view of the above, select features of various implementations in accordance with the present disclosure are highlighted below.

In one aspect, a device implementable on a firearm (e.g., an AR-style or AK-style rifle, carbine, pistol or shotgun) may include a handguard configured to at least partially surround a barrel of the firearm when the handguard is installed on the firearm. The handguard may include at least first and second physical features such that: (a) the first physical feature is configured to accommodate mounting of an accessory of the firearm on the handguard, and (b) the second physical feature is configured to secure a cable of the accessory onto the handguard.

In some implementations, the first physical feature may be configured to accommodate the mounting of the accessory on a first primary surface of the handguard. Moreover, the second physical feature may be configured to secure at least one portion of the cable of the accessory onto a second primary surface of the handguard different from the first primary surface.

In some implementations, the second primary surface may be opposite the first primary surface. For instance, the first primary surface may include an exterior surface of the handguard. Correspondingly, the second primary surface may include an interior surface of the handguard facing the barrel of the firearm when the handguard is installed on the firearm.

In some implementations, the first physical feature may include one or more slots or openings.

In some implementations, the first physical feature may include an interface system. For instance, the interface system may include an M-LOK interface system, a KeyMod interface system, a Picatinny rail, a Weaver rail, or any combination thereof.

In some implementations, the second physical feature may include: (i) at least one notch on an edge of a wall of the handguard or at least one opening on the wall of the handguard, and (ii) a protrusion with at least one indentation and disposed on an interior surface of the handguard.

In some implementations, the protrusion may include a ridge-shaped protrusion extending along a direction parallel to a longitudinal axis of the barrel. Alternatively, or additionally, the protrusion may include a ridge-shaped protrusion extending along a direction perpendicular to a longitudinal axis of the barrel.

In some implementations, at least one portion of the cable of the accessory may enter a space between the handguard and the barrel of the firearm through the at least one notch or the at least one opening on the wall of the handguard so that the at least one portion of the cable may be secured by the at least one indentation on the protrusion.

In some implementations, an opening formed by the at least one indentation may face upward with respect to the firearm when the handguard is installed on the firearm such that the at least one portion of the cable is inserted into or removed from the opening formed by the at least one indentation by a downward or upward movement with respect to the firearm, respectively. Alternatively, or additionally, an opening formed by the at least one indentation may face left or right with respect to the firearm when the handguard is installed on the firearm such that the at least one portion of the cable is inserted into or removed from the opening formed by the at least one indentation by a rightward or leftward movement with respect to the firearm, respectively.

In some implementations, the handguard may include: (i) an upper handguard portion configured to shield an upper portion of the barrel when the handguard is installed on the firearm, and (ii) a lower handguard portion configured to shield a lower portion of the barrel when the handguard is installed on the firearm. In some implementations, both the first physical feature and the second physical feature may be at least partially formed on the lower handguard portion.

In some implementations, the handguard may include a monolithic handguard having the first and second physical features.

In one aspect, a device implementable on a firearm (e.g., an AR-style or AK-style rifle, carbine, pistol or shotgun) may include a handguard configured to at least partially surround a barrel of the firearm when the handguard is installed on the firearm. The handguard may include at least first and second physical features such that: (a) the first physical feature is configured to accommodate mounting of an accessory of the firearm on the handguard, and (b) the second physical feature is configured to secure a cable of the accessory onto the handguard. The first physical feature may be configured to accommodate the mounting of the accessory on an exterior surface of the handguard. The second physical feature may be configured to secure at least one portion of the cable of the accessory onto an interior surface of the handguard different from the exterior surface. The second physical feature may include: (i) at least one notch on an edge of a wall of the handguard or at least one opening on the wall of the handguard, and (ii) a protrusion with at least one indentation and disposed on the interior surface of the handguard.

In some implementations, the first physical feature may include one or more slots or openings.

In some implementations, the first physical feature may include an M-LOK interface system, a KeyMod interface system, a Picatinny rail, a Weaver rail, or any combination thereof.

In some implementations, the protrusion may include a ridge-shaped protrusion extending along a direction parallel or perpendicular to a longitudinal axis of the barrel.

In some implementations, the at least one portion of the cable of the accessory may enter a space between the handguard and the barrel of the firearm through the at least one notch or the at least one opening on the wall of the handguard so that the at least one portion of the cable may be secured by the at least one indentation on the protrusion.

In some implementations, the handguard may include: (i) an upper handguard portion configured to shield an upper portion of the barrel when the handguard is installed on the firearm, and (ii) a lower handguard portion configured to shield a lower portion of the barrel when the handguard is installed on the firearm. In some implementations, both the first physical feature and the second physical feature may be at least partially formed on the lower handguard portion.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

an accessory with a cable; and a handguard configured to at least partially surround a barrel of the firearm when the handguard is installed on the firearm, the handguard comprising at least first and second physical features such that:

the first physical feature is configured to accommodate mounting of the accessory of the firearm on the handguard, and the second physical feature is configured to secure the cable of the accessory onto the handguard with the accessory mounted on the handguard, wherein, with the accessory mounted on the handguard, the first physical feature is configured to accommodate the mounting of the accessory on a first primary surface of the handguard, and wherein the second physical feature is configured to secure at least one portion of the cable of the accessory onto a second primary surface of the handguard different from the first primary surface, wherein the first primary surface comprises an exterior surface of the handguard, wherein the second primary surface comprises a protrusion from an interior surface of the handguard facing the barrel of the firearm such that the protrusion protrudes from the interior surface of the handguard and toward the barrel with a first distance between a tip of the protrusion and the barrel less than a second distance between the interior surface and the barrel when the handguard is installed on the firearm such that, with the cable of the accessory secured by the second physical feature, the second physical feature is configured to store the at least one portion of the cable inside and within an interior space of the handguard which is between the handguard and the barrel of the firearm, wherein the second physical feature further comprises a plurality of notches or openings formed on an edge of a respective wall of the handguard such that the plurality of notches or openings are configured to allow the at least one portion of the cable to enter and exit the interior space of the handguard between the handguard and the barrel of the firearm by wrapping around the protrusion, and wherein the protrusion allows the at least one portion of the cable to enter the interior space of the handguard in a first direction, wrap around the protrusion, and exit the interior space of the handguard in a second direction opposite the first direction.

2. The device of claim 1, wherein the first physical feature comprises one or more slots or openings.

3. The device of claim 1, wherein the first physical feature comprises a Modular Lock (M-LOK) interface system, a KeyMod interface system, a Picatinny rail, or a Weaver rail.

4. The device of claim 1, wherein the protrusion comprises a ridge-shaped protrusion extending along a direction parallel to a longitudinal axis of the barrel.

5. The device of claim 1, wherein the protrusion comprises a ridge-shaped protrusion extending along a direction perpendicular to a longitudinal axis of the barrel.

6. The device of claim 1, wherein an opening formed by at least one indentation faces upward with respect to the firearm when the handguard is installed on the firearm such that the at least one portion of the cable is inserted into or removed from the opening formed by the at least one indentation by a downward or upward movement with respect to the firearm, respectively.

7. The device of claim 1, wherein an opening formed by at least one indentation faces left or right with respect to the firearm when the handguard is installed on the firearm such that the at least one portion of the cable is inserted into or removed from the opening formed by the at least one indentation by a rightward or leftward movement with respect to the firearm, respectively.

8. The device of claim 1, wherein the handguard comprises:

an upper handguard portion configured to shield an upper portion of the barrel when the handguard is installed on the firearm; and a lower handguard portion configured to shield a lower portion of the barrel when the handguard is installed on the firearm.

9. The device of claim 8, wherein both the first physical feature and the second physical feature are at least partially formed on the lower handguard portion.

10. A device implementable on a firearm, comprising:

an accessory with a cable; and a handguard configured to at least partially surround a barrel of the firearm when the handguard is installed on the firearm, the handguard comprising at least first and second physical features such that:

the first physical feature is configured to accommodate mounting of the accessory of the firearm on the handguard, and the second physical feature is configured to secure the cable of the accessory onto the handguard with the accessory mounted on the handguard, wherein the first physical feature is configured to accommodate the mounting of the accessory on an exterior surface of the handguard, wherein the second physical feature is configured to secure at least one portion of the cable of the accessory onto an interior surface of the handguard different from the exterior surface, wherein the second physical feature comprises:

at least one notch on an edge of a wall of the handguard or at least one opening on the wall of the handguard; and a protrusion from an interior surface of the handguard facing the barrel of the firearm, the protrusion configured with at least one indentation and disposed on the interior surface of the handguard, the protrusion protruding from the interior surface of the handguard and toward the barrel with a first distance between a tip of the protrusion and the barrel less than a second distance between the interior surface and the barrel when the handguard is installed on the firearm, and wherein, with the accessory mounted on the handguard and with the cable of the accessory secured by the second physical feature, the second physical feature is configured to store the at least one portion of the cable inside and within an interior space of the handguard which is between the handguard and the barrel of the firearm, and wherein the second physical feature further comprises a plurality of notches or openings formed on an edge of a respective wall of the handguard such that the plurality of notches or openings are configured to allow the at least one portion of the cable to enter and exit the interior space of the handguard between the handguard and the barrel of the firearm by wrapping around the protrusion, and wherein the protrusion allows the at least one portion of the cable to enter the interior space of the handguard in a first direction, wrap around the protrusion, and exit the interior space of the handguard in a second direction opposite the first direction.

11. The device of claim 10, wherein the first physical feature comprises a Modular Lock (M-LOK) interface system, a KeyMod interface system, a Picatinny rail, or a Weaver rail.

12. The device of claim 10, wherein the protrusion comprises a ridge-shaped protrusion extending along a direction parallel or perpendicular to a longitudinal axis of the barrel.

13. The device of claim 10, wherein the handguard comprises:

an upper handguard portion configured to shield an upper portion of the barrel when the handguard is installed on the firearm; and a lower handguard portion configured to shield a lower portion of the barrel when the handguard is installed on the firearm, wherein both the first physical feature and the second physical feature are at least partially formed on the lower handguard portion.

* * * * *